United States Patent [19]

Clem

[11] Patent Number: 4,751,794

[45] Date of Patent: Jun. 21, 1988

[54] IN-TRACK RAIL BASE GRINDING APPARATUS

[75] Inventor: George K. Clem, Chesterton, Ind.

[73] Assignee: Holland Company, Chicago Heights, Ill.

[21] Appl. No.: 47

[22] Filed: Jan. 2, 1987

[51] Int. Cl.[4] ..... B24B 7/00

[52] U.S. Cl. ..... 51/54; 51/178; 51/241 LG; 51/110

[58] Field of Search ..... 51/178, 241 LG, 54, 51/56 R, 109, 110

[56] References Cited

U.S. PATENT DOCUMENTS

| | | | |
|---|---|---|---|
| 3,358,406 | 12/1967 | Speno, Jr. et al. | 51/178 |
| 3,883,323 | 5/1975 | Cooley | 51/178 |
| 3,908,317 | 9/1975 | Hambrick et al. | 51/178 |
| 3,974,597 | 8/1976 | Hambrick et al. | 51/281 R |
| 4,622,781 | 11/1986 | Vieau et al. | 51/178 |

*Primary Examiner*—Frederick R. Schmidt
*Assistant Examiner*—Maurina Rachuba
*Attorney, Agent, or Firm*—Mann, McWilliams, Zummer & Sweeney

[57] ABSTRACT

For grinding use on the base underside of continuous in-track welded rail type track defining a railroad right of way, for removing rail excess weld metal from the underside of the rail base, at the weld joint thereof, after ballast has been sufficiently removed from between the ties at the joint involved, in which the apparatus comprises a cart that is wheeled to ride on and extend crosswise of the track, and defines at one end a carriage way that extends to one side of the right of way, with the carriage way being equipped with a carriage which carries a post structure that is adjustable lengthwise of same, and that carries an adjustably mounted grinding head that rotatably mounts on the upper side of same a grinding wheel that is applied, when in its operative relation, to the underside of the rail base, from outside the right of way and under the rail involved, in which the grinder head may be raised by adjusting the post structure lengthwise thereof to bring the uppermost portion of the rim of the grinding wheel against the underside of the rail base joint at the gauge side edge of the rail, with the carriage being movable crosswise of the track to shift the grinder wheel across the rail base underside for grinding purposes, both being repeated as needed to grind off from the rail base underside the excess weld metal.

16 Claims, 6 Drawing Sheets

124
145
144
138
123
121
134
134
106
140
132
130
150
148
143
152
146
227
226
228
240
234
236
230
232
235
235
242
242
195
193
146
189
200
40
228
240
39
192
185
186
190
191
7
7
168
166
172
256
174
204
202
232
217
162
214
212
184
194
160
164
176
170
178
182
180

IN-TRACK RAIL BASE GRINDING APPARATUS

The present invention is directed to an in-track rail base grinder and method for removing excess weld metal of in-track welded rail lengths of so-called continuous track, and more particularly, to provide an in-track rail base grinder and method that only requires that sufficient ballast at the rail joint to be treated be removed to expose the rail base for excess weld metal removal from the underside thereof by grinding.

In-track rail joint rail welders have greatly contributed to the continuous weld rail field by providing for in-track welding right on the track right of way, and thus avoiding the need for an expensive plant to weld the rails and expensive equipment and labor to take up the older bolted joint rails, deliver them to the plant for welding and pre-weld treatment as needed, and returning the welded together rail lengths to the track. Weldments of this type may be provided using, for instance, the intrack flash butt welder marketed by Holland Company (Railweld Division), or utilizing equipment for practicing the well known Thermite welding process, one supplier of which is Du-Well Steel Products Co., Elk Grove Village, Ill. (which supplies equipment for practicing the Boutet system of Thermite welding).

A principal object of the present invention is to provide an in-track rail base grinder and a method of removal, from the underside of the rail base at rail joints of rail base excess weld metal, that is, weld upset so that at the rail joint treated the rail base underside will match the original rail base underside profile regardless of whether flash butt welding, Thermite welding, or other welding procedures or equipment were employed to weld the track rail joints together.

Another principal object of the invention is to provide an in-track rail base grinder that is wheeled for mounting on and riding on the track to be serviced, that provides a rail grinder head formed for application to same including a rail base grinding wheel having a grinding face that is directed generally upwardly, and that is power driven to rotate about the grinder head rotating axis, that provides for ready manual moving of the rail grinder head between an upper inoperative or retracted position on the cart rollerway with which the grinder is associated, and a lower operative position in which the grinder head may be disposed under the rail base undersurface or underside from outside the track right at the joint to be treated, where the ballast has been adequately removed at this location for that purpose, that provides for ready setting of the highest segment of the grinding wheel rim in grinding contact with the rail base underside at the guage side or inside edge of the track joint being treated, and that provides for easy manual movement of the grinder in a plane paralleling that of the normal cant that track rail bases conventionally have, as laid on the track, toward and away from the center line of the track from rail base underside grinding.

Yet another principal object of the invention is to provide, where the rail joint to be treated is closely adjacent a track tie, rotational adjustment of the grinder grinding wheel so as to shift the portion of the grinding wheel rim, that is to be in grinding contact relation with the rail base underside being treated, to a location closely adjacent the tie, so as to effect base underside excess weld metal removal, where the excess weld metal to be removed is adjacent the tie.

Another object of the invention is to provide an in-track rail base grinder in which, while the equipment grinder head is to have a powered grinder wheel for grinding purposes, the apparatus is otherwise manually operated to move it between grinding locations, position the grinding head grinding wheel in grinding relation with the underside of the rail base, adjust the position of the grinding wheel grinding contact relative to a closely adjacent tie under those circumstances, and shift the grinding head through its grinding stroke across the width of the rail base at the joint being treated.

Still another object of the invention is to provide an in-track rail base grinder that is of simplified construction requiring motive power only for the grinder head, that is economical of manufacture, that is efficient in use, in connection with the removal from the underside of the rail base of excess weld metal left by the practice of all state of the art in-track welding methods for providing continuous welded rail, and that accommodates rail base joint grinding to within one-half inch of an adjacent tie.

In accordance with the present invention, a rail track base grinder and method is provided for use in connection with railroad track of the continuous rail type in which the individual rails of the track are made up of rail lengths welded together by conventional in-track rail welders, which track rails are welded together in end to end, joint forming relation, utilizing one of the in-track welding techniques known to the art for this purpose, such as the flash butt welding or the Thermite welding that have been referred to, both of which form the rail joints involved only between spaced track ties, so that the excess weld metal, that is left after welding, protruding from the underside of the rail base of the joint involved, can be removed by grinding after removal of sufficient ballast from below the joint in question to expose the underside of the rail base at the joint being treated.

The in-track rail grinding apparatus of the invention comprises a cart having one set of flanged wheels aligned in a first vertical plane for riding on one of the track rails, and a second set of flanged wheels aligned in a second vertical plane for riding on the other of the track rails. The cart defines a frame oriented to extend crosswise of the track but riding or resting on the track rails, with the simplified construction involved calling for the cart to be moved manually between grinding locations.

The cart frame at at least one end of same is formed to define a rollerway or carriage way extending across the indicated vertical plane that is at that end of the cart, including a pair of spaced rail members disposed on either side of the rollerway and extending generally longitudinally on the frame, of which a wheeled carriage is mounted to ride in the operative relation of the grinder. The cart carriage has a telescoping post structure adjustably secured thereto that depends therefrom in the operative relation of the grinder, with the post structure carrying a grinder head that is positioned to be disposed, in the operative relation of the grinder, adjacent but under the level of the exposed rail joint base to be treated, when the cart is seated on the track above the indicated exposed rail joint that will be located between two of the track ties. Removal of one or both of such ties is not needed or required for grinding purposes, in accordance with this invention.

The apparatus grinder head, in accordance with the invention, comprises an elongate body oriented to extend generally longitudinally of the frame rollerway or carriage way, with the grinder head body defining a head end that, in said operative position of the grinder, is oriented to be disposed below the rail joint to be treated, with the grinder head body also defining a tail end that extends oppositely of the grinder head end thereof and to the other side of the grinder post structure.

The grinder head body includes means for rotatably mounting a grinding wheel on the top of the head and to the side of the said post structure that faces the rail joint to be treated, and for rotation about an axis extending normally of the grinder head, with power means being provided for power driving the grinding wheel about said axis.

The grinder head body is connected to the grinder telescoping post structure intermediate the ends of the grinder head, and is supported from the grinder post structure to, in the operative position of the grinder, downwardly angle the grinding wheel in a plane that is at a flat angle in relation to the horizontal, and that inclines downwardly in a direction outwardly of the track right of way and away from the center line of the right of way defined by the track, and thus toward the grinder head body tail end to provide a flat angle attack of the grinding wheel on the underside of the rail base being treated.

The indicated post structure that supports the grinder head in the operative relation of the grinder apparatus is manually adjustable lengthwise of same, after the driving of the grinding wheel starts, to dispose the grinder head and its rotating grinding wheel to bring the elevationally uppermost portion of the rotating grinding wheel rim into grinding contact with the rail base underside at the track joint to be freed of base excess weld metal and at a position substantially flush with the inside edge or gauge side of the rail.

With the grinder head grinding wheel appropriately in rotating grinding contact with the rail base of the joint being treated, the grinder head supporting carriage is equipped to permit the operator to manually shift same laterally of the track to bring the grinder wheel laterally across the rail base joint being treated, and in parallelism to the normal cant of track rails in the direction of the center line of track. The apparatus grinder head is then repositioned to the gauge side of the rail being treated and raised by adjusting the telescoping post structure to again bring the indicated portion of the rotating grinding wheel rim into contact with the rail base, and the movement of the grinder carriage and associated head laterally of the track rail in question is again effected to make another grinding pass along the underside of the joint being treated. This adjustment and grinding movement are repeated until the weld area at the underside of the joint being treated matches the original profile of the rail being treated.

The apparatus of the invention is arranged so that when the rail joint being treated is in close adjacency to one of the track ties, the location of the grinder head grinding wheel contact with the rail base may be rotated toward the tie in question so that when further grinding passes are made across the bottom of the rail base, the weld material up to within one-half inch of such tie may be appropriately ground, with this action being repeated as needed to shape the weld joint area involved to the original profile of the rail.

The in-track rail base grinder of the present invention is also arranged for shifting the grinder assembly that includes grinder carriage, the adjustable post structure carried thereby, and the grinder head, as a unit, to an inoperative position on the cart frame, in the plane of the frame, for convenient carrying between grinding locations. At each grinding location, the grinder assembly that includes the grinder carriage, the adjustable post structure carried thereby, and grinder head, as a unit, is returned to its operative grinding relation with respect to the joint being treated, after sufficient ballast has been removed from beneath the rail base of the joint to be treated, for positioning of the grinder head grinding wheel with respect thereto, as has been described.

Other objects, uses, and advantages will be obvious or become apparent from a consideration of the following detailed description and the application drawings in which like reference numerals indicate like parts throughout the several views.

Figure 1:
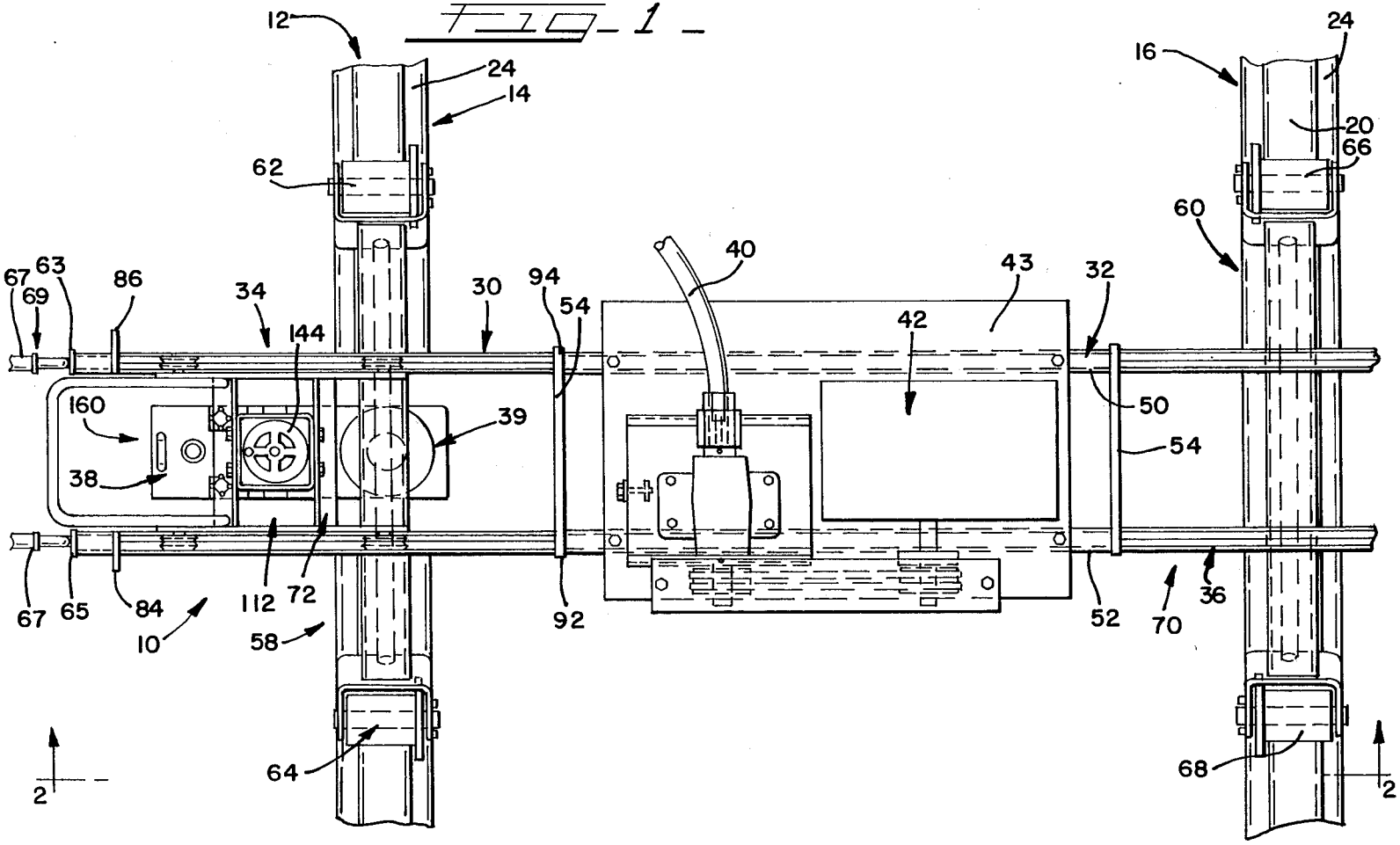
FIG. 1 is a diagrammatic plan view of one embodiment of the invention mounted on the rails of a track of a continuous rail type aforeindicated, and positioned at a grinding location for a joint in the left hand track rail, with the right hand end of the cart involved broken away to permit a larger scale showing of the grinder in plan.
Figure 9:
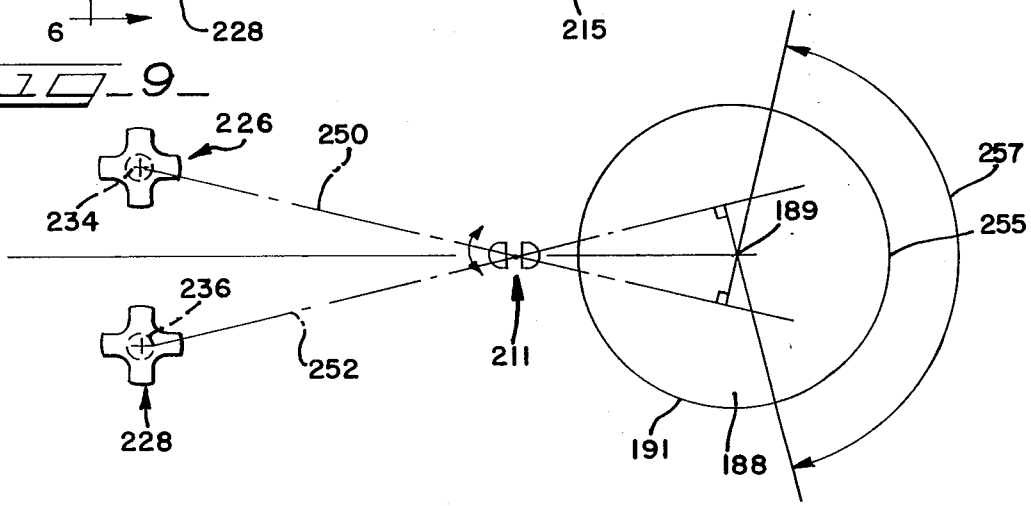
Figure 8:
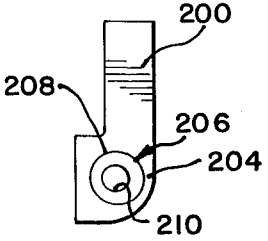
FIG. 8 is a side elevational view of one of the connecting bracket members of the adjustable post structure to which the grinder head is connected, diagrammatically illustrating the spherical bearing arrangement involved at that location.
Figure 10:
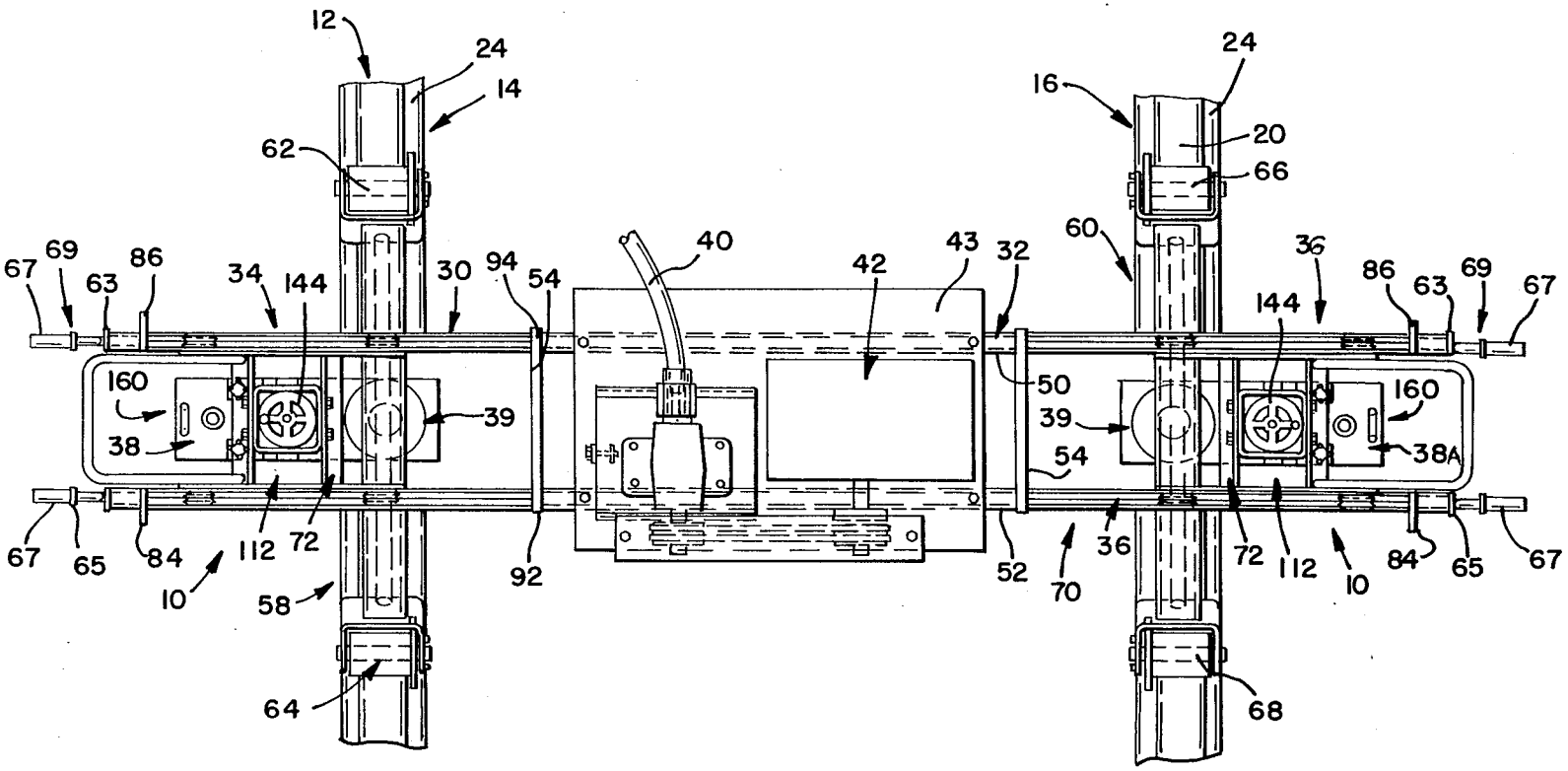

FIG. 9 is a diagrammatic, schematic view illustrating the gimbal type adjustment that is permitted by the apparatus of the present invention for shifting the elevationally uppermost portion of the grinding wheel rim, that is to be raised into grinding contact with the rail base at the inside edge of the rail from side to side, to grind away the excess weld metal where one of the ties at the rail joint being treated is in close adjacency thereto; and FIG. 10 is similar to FIG. 1, but is on a smaller scale to show the complete grinder cart at both ends of the cart, and in the form illustrated, both ends of the cart are equipped with a separate grinder assembly arranged in accordance with the present invention.

However, it is to be distinctly understood that the specific embodiment illustrated in the application drawings is provided primarily to comply with the requirements of the Patent Laws, and that the invention is susceptible of modifications and variations that will be obvious to those skilled in the art, and which are intended to be covered by the appended claims.

GENERAL DESCRIPTION

Figure 2:
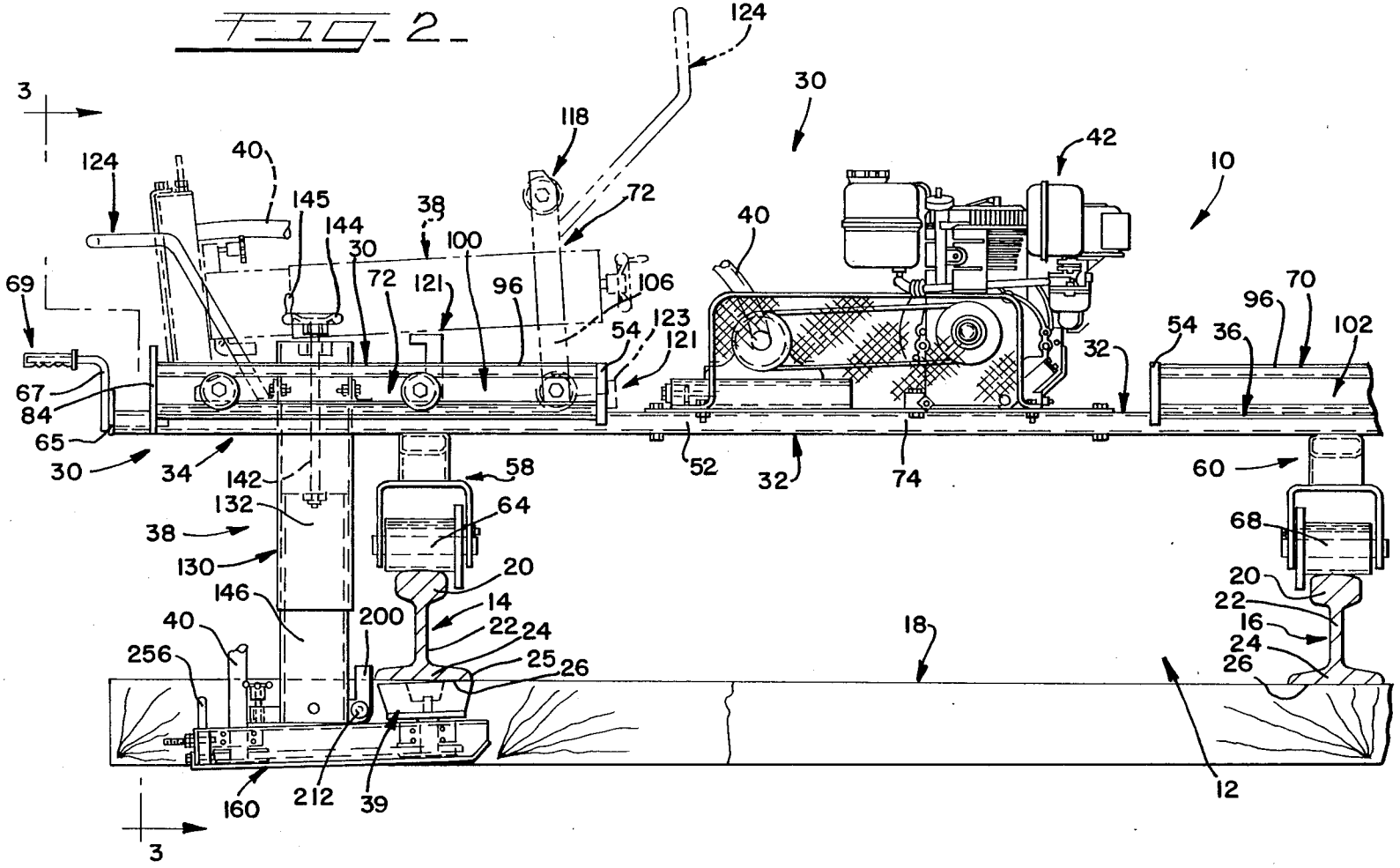
FIG. 2 is a front elevational view of the apparatus shown in FIG. 1, taken substantially along line 2—2 of FIG. 1, with the left hand end of the tie in front of the grinder apparatus grinding head being broken away to expose the grinder head and associated parts.
Figure 3:
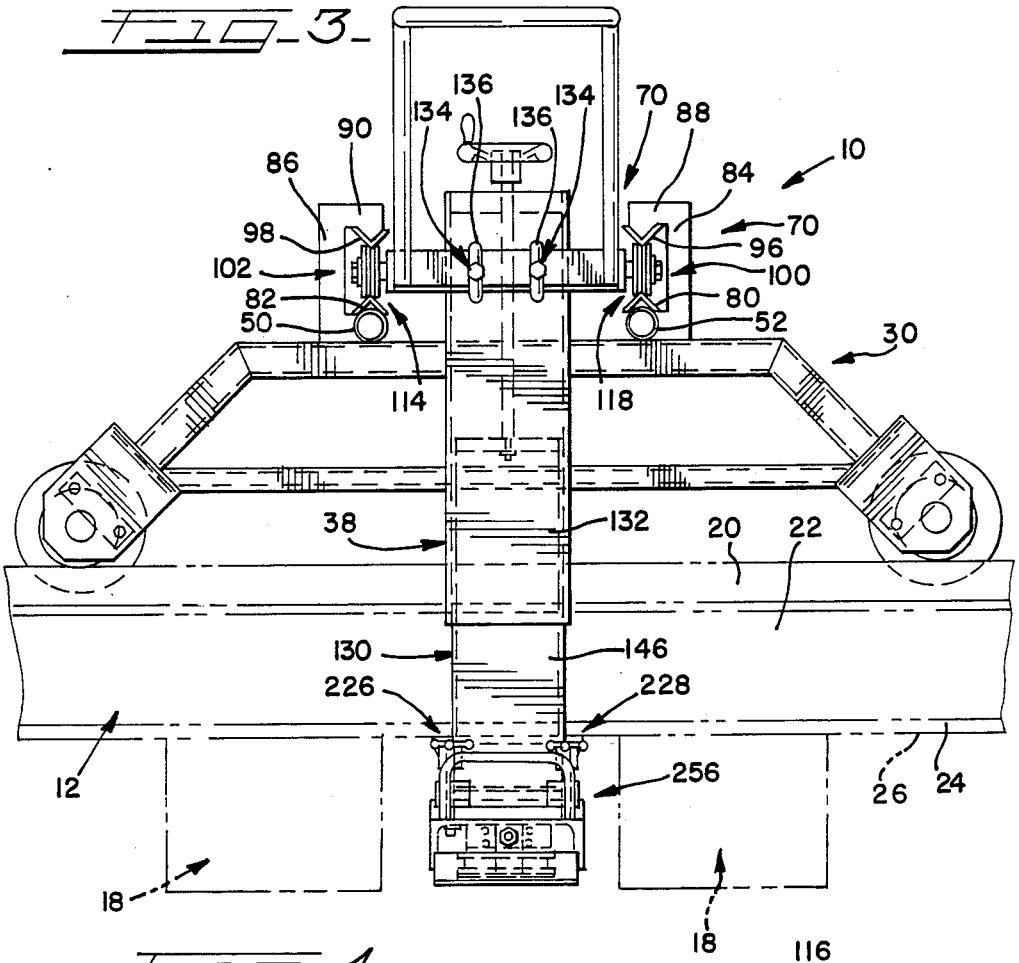
FIG. 3 is a left hand end elevational view of the grinder apparatus, taken substantially along line 3—3 of FIG. 2, with both the ties shown in FIG. 2 shown in dashed lines.
Figure 4:
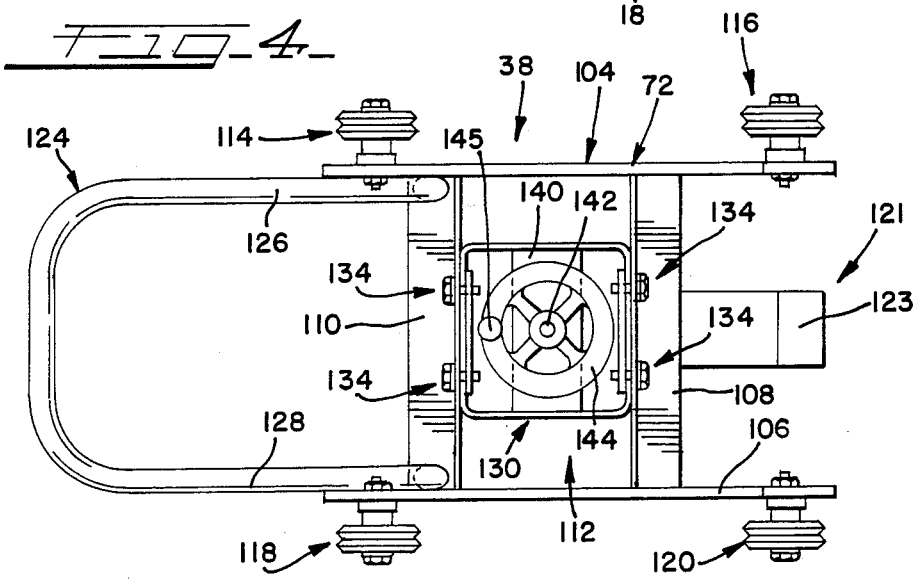
FIG. 4 is a top plan view of the grinder apparatus subcombination or assembly with which the cart of this apparatus is equipped and with the lower section of the post structure and the grinder head omitted.

Reference numeral 10 of FIGS. 1–3 generally indicates one embodiment of an in-track rail base grinder arranged in accordance with the present invention.

The in-track rail base grinder 10 is arranged for use in connection with the so-called continuous welded rail track in which the individual track rails are in-track welded in end to end relation using an in-track welder of one of the types hereinbefore referred to, which machines as part of their operation require that the rail welds be made between the ties of the in-track rails involved. These machines utilize welding techniques to weld the ends of the rails together in making the track rails of the "continuous" type.

As is well known in the art, flash butt welding of rails creates what is known as a "flash" about the weld joint that is excess weld metal, also known as weld upset, which is to be removed after the weld is cooled, while practice of other forms of in-track rail joint welding, including Thermite welding, also create excess weld metal, that is, weld upset at the weld joint that is to be removed after the weld has cooled. The base of the track rail in its welded condition at the joint will have the excess weld metal referred to protruding downwardly from the joint across the width and undersurface of the joint, and thus extending from the inside edge to the outside edge of the rail base involved. This rail base excess weld metal has to be removed for a number of reasons.

The present invention is directed to an intrack rail base grinder apparatus that, as has already been mentioned, is generally indicated by reference numeral 10 of FIGS. 1–3 and that is adapted for use, in the operative relation of the grinder, to grind the rail base excess weld metal (whether of flash butt origin or otherwise) away until the area of the weld at the underside of rail base matches the original profile of the rail before the in-track rail weld procedure was preformed. For this purpose, the apparatus 10 is wheeled to ride on the rails of a "continuous" rail track, in which the individual rail lengths have been welded together in end to end relation by utilizing one of the in-track welding techniques referred to. The invention contemplates that the base grinder apparatus 10 is equipped at at least one end of same with a base grinder assembly that may be manually moved between operative and inoperative positions; for simplification purposes, the apparatus 10 with its base grinder assembly disposed in its inoperative position, which is at the top of this apparatus, is to be manually moved between weld positions along the length of continuous weld track involved, and at each welding position, the apparatus 10 is positioned on the track to dispose the apparatus base grinder in a vertical plane extending transversely of the track that is substantially aligned with the rail joint to be processed in the practice of the invention and the base grinder assembly is disposed in its operative position, it being lowered for grinding application to the base of the rail joint to be serviced. For further movement of the apparatus 10 between welding positions, the base grinder assembly in accordance with the present invention, is disposed back in its inoperative position on top of the apparatus.

When the apparatus 10 is aligned transversely of the track with the initial rail joint to be processed in the practice of the invention, sufficient ballast between the two rail ties involved and underneath the rail joint in question is removed to expose the rail base at the former joint to be processed, so that the base grinder assembly of the invention can be moved from its elevated inoperative relation on top of the apparatus 10 to its lowered operative relation for rail base underside grinding of the rail joint in question in accordance with the invention. After the rail joint has been processed in accordance with the practice of the invention, to return the joint base underside weld area to the original profile of the rail, the base grinder assembly of the invention is returned to its elevated inoperative relation on top of the apparatus 10, for movement of apparatus 10 to the next grinding location, which would be the next welded joint of the rail being serviced; the next consecutive welded rail joints are serviced in like manner.

Referring now more specifically to the drawings, reference numeral 12 generally indicates a continuous welded track of the type indicated, which comprises a pair of the usual track rails 14 and 16 that are applied to the usual track ties 18 to define the familiar railroad right of way for track 12. The conventional tie plates and spikes therefore have been omitted to simplify the drawing, with the continuous rails 14 and 16 in practice being made up of a series of rail lengths that are welded in end to end relation using in-track welding techniques of one of the types indicated. Each rail includes the usual and familiar rail head 20, rail web 22 and rail base 24 that normally are formed of one piece construction form the rail length in question, at a rolling mill or the like. The usual configuration of these portions of the rail are diagrammatically illustrated in vertical section in FIG. 2, with the rail base 24 being formed to define a downwardly facing undersurface or underside 26. As is conventional, the rails 14 and 16 are applied to or seat in the usual canted tie plates and thus form the track 12 so that rails 14 and 16 reflect the standard pitch of rails in the direction of the center line of track, the ratio of 1 to 40 being standard in the railroad field. Thus, the rails 14 and 16 in practice are applied to form the track 12 so that the undersides 26 of the rail bases 24 are disposed in a flat angle, upwardly angled relation, normally at the standard ratio of 1 to 40, to cant each rail sidewise thereof in the direction of the center line of the track 12; however, the invention will accommodate any cant specified by the owner of the track 12.

With the foregoing in mind, the in-track base grinder apparatus 10 generally comprises a cart 30 defining a frame 32 having two similar outwardly projecting end portions 34 and 36 that are similar in construction, with the end 34 being also adapted to removably and adjustably support a rail base grinder assembly 38. It is a feature of the invention that the rail base grinder assembly 38 could be applied to either frame end portion 34 or 36, with the rail base grinder assembly 38 being shown at the left hand end 34 of the frame 30 as it is shown in FIGS. 1–3 for use in grinding joints in rail 14. In order to grind joints in rail 16, using the cart 30 of FIGS. 1–3, the cart 30 may be manually picked up from track 12, swung one hundred eighty degrees, and reapplied to track 12, for use in grinding welded joints in rail 16.

Alternately instead of reapplying the cart 30 to the track 12, the base grinder assembly 38 may be removed from the left hand end 34 of the frame 32, and reapplied to the right hand end 36 of the frame 32, for use in grinding welded joints in rail 16. In FIG. 10, the cart 30 is shown as having a base grinder assembly 38 at each end of same, so that both track rails 14 and 16 may be serviced as cart 30 is moved along track 12, in one direction therealong, from rail joint to rail joint.

In the showing of drawing FIGS. 1–9, the base grinder assembly 38 is operably mounted on the left hand end 34 of the frame 30, and for movement between the broken line retracted and full line operative positions of same that are shown in FIG. 2. The indicated elevated retracted position of assembly 30 is the position that the assembly 38 is shifted to for movement between rail base weld grinding positions, while the full line position of the indicated base grinder assembly 38 of FIG. 2, which is also the position of same that is indicated in FIG. 3, is the operative relation that the base grinder assembly 38 is shifted to when the apparatus 10 is disposed at a weld grinding position along the length of rail 14, with sufficient ballast being removed from between the ties 18 at that location to swing the assembly 38 to its indicated operative relation. The identical base grinder assembly 38A at the cart right hand end 36 is operated in the same manner (so only one grinder assembly 38 will be described).

A feature of the invention is that the base grinder assembly 38 in its operative relation is equipped with a conventional, off the shelf, grinding wheel 39 that may be of the type hereinafter referred to or its equivalent, which grinding wheel is power driven through suitable flexible cable 40 (which is shown only diagrammatically as it may be of any suitable type) that is driven by a suitable drive motor assembly 42 (which is also shown only diagrammatically as it may be of any suitable type and suitably mounted on cart 30, a suitable gasoline powered motor assembly being employed in a commercial embodiment of the invention). Such facilities for operating the second base grinder assembly 38A of FIG. 10 may be duplicated or operated in duplicate (where this embodiment is employed) as desired or necessary.

The invention further contemplates that to achieve simplicity and economy of the arrangement, each base grinder assembly 38 in being applied to, and moved from, the underside of the rail base 26 is manually set to bring the grinding wheel 39 in grinding relation with the undersurface 26 of the rail base, and is moved longitudinally of the cart 30 and transversely of the respective rails 14 and 16, manually, between the assembly operative and inoperative positions, these operations being repeated as needed at each grinding location to return the undersurface 26 of the rail base 24 to its original profile prior to welding.

The invention also contemplates that for each assembly 38, and for the case where the rail joint being treated is closely adjacent to one of the ties 18, the elevationally highest portion of the grinder base assembly grinding wheel 39 that makes the grinding contact with the base excess weld metal indicated may be rotationally adjusted from essentially flush positioning at the inside edge of the rail to a position closely adjacent the adjacent tie 18, for removal of excess weld metal adjacent the tie. The arrangement of the present invention permits a base weld joint to be ground within one-half inch of a tie 18.

SPECIFIC DESCRIPTION

The cart frame 32 is formed to be of suitable tubular steel construction with appropriate reinforcement being provided where the engine 42 is to be mounted. In the form shown, the frame 32 comprises a pair of tubular steel members 50 and 52 that are secured together in spaced apart relation by welding suitable cross members 54 therebetween, and suitably fixing the drive motor base plate 43, as by employing welding, nuts and bolts, etc.

To either side of the respective cross members 54 the frame 32 has the suitable wheeled trucks 58 and 60 affixed thereto, using welding techniques and the like. The truck 58 suitably journals the respective single flanged wheels 62 and 64 that are to ride on the rail 14, while the truck 60 suitably journals single flanged wheels 66 and 68 that are to ride on the rail 16, as indicated in FIGS. 1 and 2. It will be seen that the flanged wheels 62 and 64 lie in the vertical plane that includes the rail 14, while the frame wheels 66 and 68 lie in a vertical plane that includes the rail 16.

As has already been indicated, the outer ends 34 and 36 of the frame 32, as such, are identical, as indicated by corresponding reference numerals. At the ends 34 and 36, the tubular members 50 and 52 each have end plates 63 and 65 fixed thereto (as by employing welding), with suitable L-shaped handles 67 also being affixed thereto (as by employing welding) so that the frame 32 at its ends defines spaced outwardly projecting pairs 69 and 71 of cart grasping handles for manual moving of the cart 30 onto and away from track 12, or swinging the cart to change track rails it rides on.

The frame 32 at its respective ends 34 and 36 defines a rollerway or carriage way 70 for the carriage 72 of the base grinder assembly 38.

An important feature of the present invention is that while the mid portion 74 of the frame 32 that carries the motor assembly 42 may be essentially horizontally disposed, the tubular frame members 50 and 52 at approximately the location of the respective cross members 54 are bent to be upwardly directed at the indicated 1 to 40 ratio that represents the conventional and standard cant of the installed rails 14 and 16; where a particular track 12 has a cant that is other than the indicated standard cant, the tubular frame members are bent upwardly at the cant of track 12 where the cart 30 is to be used on such track 12. Thus, the rollerways 70 of frame 32 are similarly inclined in opposite directions to respectively parallel the indicated cant of the track rails 14 and 16.

Each rollerway or carriage way 70 is formed by a pair of lower rail forming members 80 and 82 (see FIG. 3) that are fixed to the respective frame defining members 50 and 52, as by employing welding or the like, and in the spaced apart relation indicated in FIG. 3. The respective rails 80 and 82 illustrated are of the angle member transverse cross-sectional configuration shown in FIG. 3, and extend between, at each end 34 and 36 of the frame 32, the cross member 54 at that end and the respective C-shaped bracket members 84 and 86. Bracket members 84 and 86 also define the respective upper end portions 38 and 90 (see FIG. 3) between which, and the corresponding end portions 92 and 94 of the respective cross members 54, are affixed, as by employing suitable welding, the respective upper rail members 96 and 98 that respectively parallel the lower rail members 80 and 82. The rollerways 70 thus define on either side of same guideways 100 and 102 that parallel the respective frame end portions 34 and 36, and thus have the indicated track rail cant that has been referred to, with the respective guideways 100 and 102 being open, at the extreme ends of the frame 32, for permitting the inoperative positioning of assembly 38 that has been indicated, or its manual transfer between rollerways 70.

The carriage 72 of the rail base grinder assembly 38 (see FIGS. 4 and 5) comprises a pair of spaced apart longitudinally extending members 104 and 106 that are joined together by spaced apart transverse members 108 and 110, utilizing suitable welding techniques, to define a carriage open center 112. The carriage frame member 104 appropriately journals spaced rollers 114 and 116 that are to ride in the guideway 102 of rollerways 70, while the carriage member 106 appropriately journals rollers 118 and 120 that are to ride in the guideway 100 of the rollerway 70. As indicated in FIG. 3, the upper rail members 96 and 98 are also of angled configuration, and the configuration defined by the C members 84 and 86 makes the guideways 100 and 102, as already indicated, open at the ends of the guideways 100 and 102, so that, for instance, the base grinder assembly 38 can be shifted between its retracted position shown in broken lines in FIG. 2, in which one set of rollers 114 and 118 are completely retracted from the guideways 100 and 102, respectively, with the assembly 38 being then disposed so that its catch arm 121 may be inserted under the frame cross member 54 for engagement by the catch arm tab portion 123 that is then in locking relation with the indicated cross member 54 (which is formed at the lower central portion of same for this purpose). To assist in this positioning of the assembly 38, handle 124 of angled U configuration is provided, which has its angled legs 126 and 128 suitably fixed, as by employing welding techniques, to the respective carriage longitudinally extending frame members 104 and 106, respectively.

The base grinder assembly 38 (see FIG. 5) also includes the telescoping post structure 130 dependently secured to the carriage 72 within its open center 112. Post structure 130 comprises an upper sleeve 132 of quadrilateral transverse cross-sectional configuration adjustably secured to the carriage 72 by suitable nut and bolt assemblies 134 applied to the respective slots 136 formed in opposite side walls of the upper sleeve 132. Upper sleeve 132 at its upper end 138 has fixed across same, as by employing suitable welding techniques, a cross bar 140 in which a threaded shaft 142 is suitably threadably mounted, with the shaft 142 having suitably keyed to same operating hand wheel 144 that may be provided with upstanding operating handle 145 for ease of rotating a threaded shaft 142.

The post structure 130 also comprises a lower sleeve 146 that is also of quadrilateral transverse cross-sectional configuration, that is telescopingly mounted within sleeve 132 and that has fixed across its upper end 148, as by employing suitable welding techniques, a cross bar 150, in which the lower end 152 of the threaded shaft 142 is suitably journaled, as by employing suitable lock ring 143.

When the base grinder assembly 38 is disposed as indicated in full lines in FIG. 2, as at a grinding position of the apparatus 10, the assembly carriage 72 is fully returned to its rollerway 70 so as to dispose the post structure 130 it carries in the substantially dependent relation that is indicated.

As indicated in FIGS. 5–8, the post structure 130 lower sectin 146 adjustably carries grinder head 160 that is of elongate box construction and defines a head end 162 and a tail end 164 between which the grinder head 160 is adjustably connected to the post structure lower section 146.

The grinder head 160 defines an open top socket 166 in the upper side 167 of the grinder head 160 at its tail end 164 of same, for reception of a conventional polygonal drive bar 170 of conventional connector 168 of the conventional flexible driving shaft 40, with the connector 168 being suitably operatively connected with the squared (in this instance) driving shaft 170 that is in keyed relation with the journaled disc member 172 that mounted for adjustment longitudinally of the head 160 utilizing suitable adjustment screw 174 and associated nuts 175 in a conventional manner. Also received on drive member 170 is suitable pulley 176 (that is suitably keyed to disc member 172) which is connected by a suitable drive belt 178 (that may be of the V-type) that is trained over suitable pulley 180 which is suitably keyed to drive pin 182 that may be appropriately journaled as indicated at 184 and includes a suitable seat 185 and threaded mounting pin 186 for securing conventional grinding stone 39 thereto in any conventional rotary motion transmitting manner for driving wheel 39 about axis of rotation 189.

The grinder stone 39 is preferably one of the many off the shelf items offered by many companies, one suitable form being the grinder stone product sold under the trademark NORZON and offered by Norton Company of Worchester, Mass. Grinding stones 39 of the type indicated are of particulate composite structure involving the basic grinding grit material and the binder product, and are shaped to define an essentially planar grinding face 190, a frusto-conically configured edging 192, and a planar undersurface 194 which is applied to the grinder head seat 184. The stone face 190 and edging define circular rim 191.

The grinder head 160 is connected to the post lower section 146 (and thus post structure 130) at basically three adjustable connecting positions having adjustable connecting devices 211, 226 and 228. The side 193 of the post structure 130, that faces the grinder wheel 39 has an L shaped arm 200 affixed to the post lower section 146 as at 202, with the L shaped arm 200 having journaled at its lower apex portion 204 a spherical bearing 206 (see FIG. 8) of a conventional type that is mounted within the aperture 208 of the arm member 200 for swiveling movement (as by employing swagging techniques). Bearing 206 defines cross aperture 210 therethrough for receiving cross pin 212 that extends between the lugs 214 and 216 that are suitably affixed to the top plate 217 of the grinder head 160 (as by employing suitable welding procedures), with the pin 212 being illustrated as having head end 218 and shank 220 that receives suitable locking key 222 (a cotter pin in the illustrated embodiment, see FIG. 7). This is swivel pivot device 211.

Figures 5, 6:
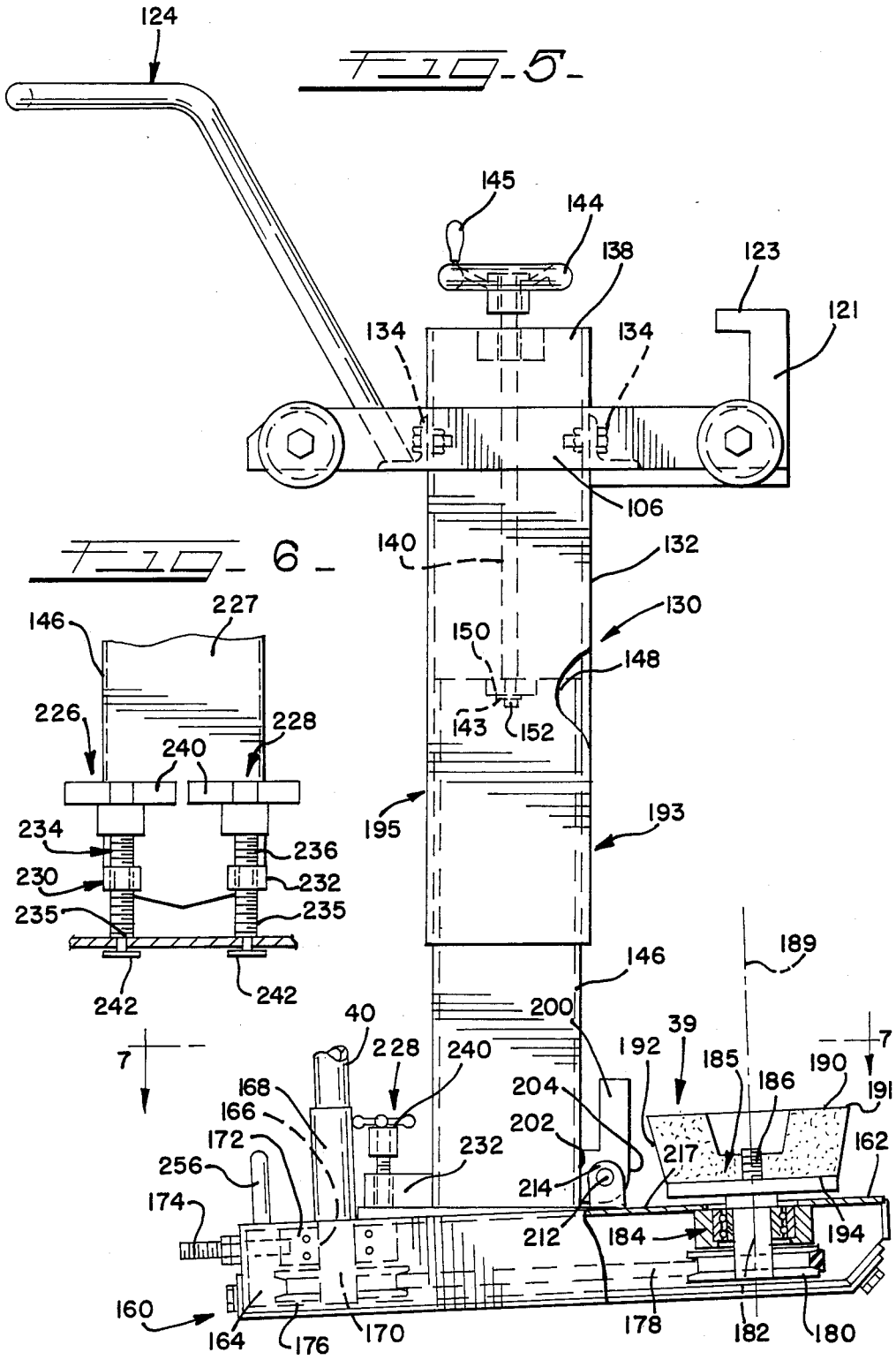
FIG. 5 is an elevational view of the grinder assembly as shown in FIG. 2 but illustrating the unit by itself and on a greatly enlarged scale, and with the grinder head being shown in partial section.
FIG. 6 is a fragmental side elevational view of the lower end portion of the lower section of the adjustable post that supports the base grinder and shown in FIG. 5, taken substantially along line 6—6 of FIG. 7.
Figure 7:
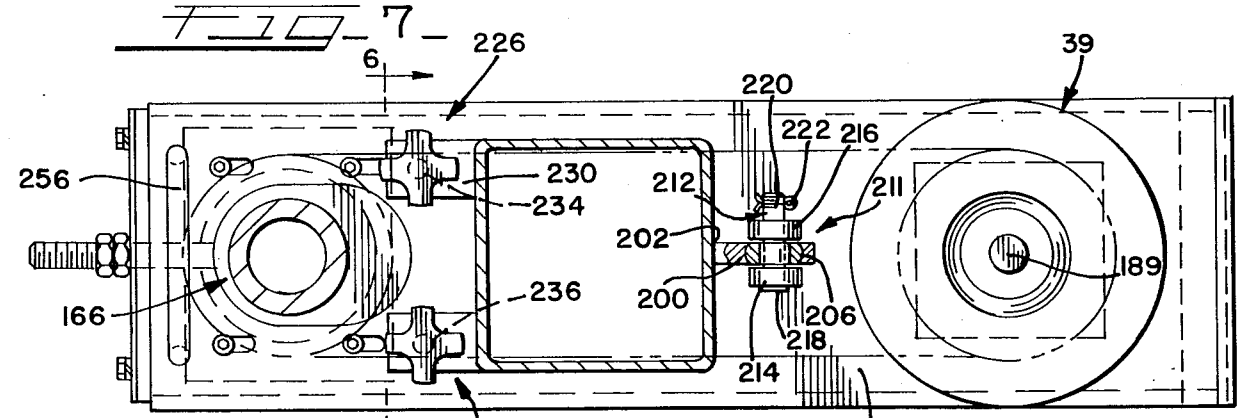
FIG. 7 is an enlarged top plan view of the grinder head itself, taken substantially along line 7—7 of FIG. 5, and with the lower section of the grinder head assumed to be horizontally disposed and the grinder assembly post structure being shown in section.

On the other side 195 of the post structure 130 a pair of hand operated screw threaded adjusters 226 and 228 are provided. For this purpose, the backside 227 of the post structure lower section 146 is provided with a pair of outwardly extending arms 230 and 232. The screw threaded adjustment device 226 includes a threaded screw member 234 in screw threaded relation with the arm 230, and having its lower end suitably keyed to the grinder head 160 (see FIG. 6), while the screw adjustment member 228 includes threadede screw member 236 that is screw threadedly received in arm 232 and that is suitably keyed to the grinder head 160 (as indicated in FIG. 6), where it is seen that the respective screw threaded adjusted members 226 and 228 each include a grasping handle 240, and the dependent ends 235 of the respective screw members 234 and 236 are each reduced and tack welded to a washer 242 disposed on the underside of the grinder head top plate 244; The respective washers 242 of head 160 are free to rotate with the respective threaded members 234 and 236.

The arrangement of the grinder head connecting and adjustment devices 211, 226, and 228 is such that the diagrammatically and schematically illustrated relationship of FIG. 9 is provided, in which the screw members 234 and 236 operate through the respective levers 250 and 252 of substantially equal lengths that intersect at the pivot point of the grinding wheel 39 to rotate the swivel pivot device 211 circumferentially thereof the distance indicated by the arrow 257 (approximately 120 degrees), about the axis of rotation 189, so that in the event that the rail joint to be treated by the practice of the invention is in close adjacency to one of the ties 18, the grinder head 160 may be adjusted to so position the grinding wheel 30 that it will grind the welding flash up to within about one-half inch of the adjacent tie 18.

The grinder head 160 at its tail end 164 may be provided with a suitable grasping handle 256 to facilitate positioning of head 160.

As indicated, grinder assembly 38A is the same as grinder assembly 38.

OPERATION

The in-track base grinder 10 (assuming it is equipped with a single grinder assembly 38 at its left hand end 34) is manually applied to a track 12 by several handlers grasping the respective pairs of spaced apart handles 69 that are on either end of the frame 32, and lifting the frame to place its respective sets of wheels 62, 64 and 66, 68 on the respective track rails 14 and 16, with the base grinder assembly 38 being applied to the apparatus 10 in its dashed line inoperative elevated position of FIG. 2.

The apparatus 10 may then be manually moved along the track 12 to the first weld joint to be treated thereby, which will be in the track 14 in the arrangement as illustrated in the application drawings FIGS. 1–9. At this location the movement of the apparatus 10 longtudinally of the track 12 is stopped and the frame 32 more or less vertically aligned with the rail joint weld to be treated, after which enough of the ballast between the ties 18 that will be on either side of the rail joint to be treated is removed from beneath the rail to expose the base of the rail at the rail joint to be treated and also to insert the apparatus grinding assembly head 160 underneath same from outside the track right of way involved to essentially the position shown in FIG. 2, after the grinder assembly 38 is swung from its elevated inoperative position to its lowered position outside of the track right of way and to the left of its operative full line position of FIG. 2 (using handle 124 for this purpose, after shifting assembly 38 sufficiently to free catch arm 121 from cross member 54, and rollers 114 and 118 being then returned to their respective guideways 100 and 102). The drive mechanism 42 for driving the grinding wheel is then started, it here being assumed that the grinding head 160 is sufficiently below the undersurface 26 of the rail base 24 to initially avoid contact therewith, or with the excess weld metal (weld upset) that protrudes from the undersurface of the weld at the joined together rail bases.

As indicated hereinbefore, the grinder head 160 has a position of zero adjustment so that the face 190 of the grinding wheel 39 will be inclined downwardly, outwardly of the track right-of-way, at a flat angle that lies in the range of between one and five degrees, so as to present a predetermined angle of attack, of the grinding wheel 39, to the underside 26 of the rail base 24. This is achieved by placing adjusting devices 226 and 228 at the same positions of adjustment that will produce this angulation. The operator positions the assembly 38 along the rollerway 70 as needed to dispose the wheel elevationally uppermost portion 255 at the grinding wheel rim 191 in substantially vertical alignment with the inside edge 25 at the gauge side of the rail, and then the operator vertically adjusts the post structure 130 using hand wheel 144 and its handle 145 as needed to bring the grinding wheel rim portion 191 into physical contact with the excess weld metal as at 255. The post structure 130 at the nut and bolt devices 134 provides for rough height adjustment of the grinding head 160 for the particular rail weld to be treated, while the lower section 146 of the post structure 130 is then appropriately adjusted utilizing hand wheel 144 and its operating handle 145 to turn the threaded shaft 142 as needed to raise the post structure 146 into grinding wheel engagement with the rail based flange of the joint being treated. The grinding wheel 39 is rotating but the elevationally upper portion thereof that makes the grinding contact at 255 remains at the same position.

When the apparatus grinding wheel makes contact with the excess weld metal at the base inside edge 25 of the rail structure 14, the operator manually moves the assembly 38 outwardly of the right-of-way along railway 12 (to the left of FIGS. 1 and 2) to move the grinding stone transversely across the rail base underside in grinding relation thereto, and in a plane that parallels the canting of the rail base 24 of rail structure 14. This is done by the operator pulling on handle 124 to move the assembly carriage 72 along carriage way or rollerway 70. When the first pass has already been completed, the operator manually returns the assembly 38 to the original position (using handle 124), and again raises the grinding head 160 to bring the grinding wheel 39 at its elevationally uppermost portion 255 into grinding relation with the rail base underside, and repeats the manually actuated grinding stroke across the rail base undersurfacing 26. This reelevation of the grinding wheel 39 and the subsequent grinding stroke operation are repeated until the undersurface of the rail base weld area matches the original base undersurface profile of the rail.

Where it happens that the rail joint in question is located closely adjacent one of the ties 18, the adjustment arrangement represented by the adjustment devices 211, 226, and 228 is brought into operation. Assuming that the joint in question is located closely adjacent the right hand tie 18 of FIG. 3, the adjustment device 226 is operated to raise the head 160 on that side of same, while the device 228 is operated to lower the head 160 on its other side a corresponding amount, which will shift the location of the elevationally uppermost portion 255 of the grinding wheel that contacts excess weld metal of the joint in question toward the indicated right hand tie. Where the joint is adjacent the left hand tie of FIG. 3, the adjustment devices 226 and 228 are oppositely operated. In both instances, the connecting pin shank 220 causes a resulting rocking movement of the spherical bearing 206 in arm 200 as needed to accommodate the rotational motion of the grinding wheel that is involved, thereby providing a gimbal type adjustment action for the grinding wheel 39 that will grind welding excess weld metal up to within one-half inch of the respective ties 18. In such instance, the elevation of the grinding head 160, and the manually operated grinding stroke are repeated so that the underside of the rail base, even closely adjacent a tie 18, matches the original profile of the rail.

When grinding has been completed at a particular joint grinding site, to the end indicated, the drive mechanism 42 is shut off, and the grinding base assembly 38 returned to its elevated inoperative relation of FIG. 2 using handles 124 and 256 as needed. The apparatus 10 is then manually moved to the next grinding location, and the grinding sequence referred to is repeated as needed to grind the weld area involved to the point where the rail structure base at the joint involved matches the original profile of the rail.

By applying the base grinder assembly 38 to one of the ends 34 or 36 of the apparatus 10, the rail welds on that side of the track may be all treated as indicated, after which the apparatus 10 may be grasped at its frame handles 69 and 71, turned 180 degrees, and reapplied to the rails 14 and 16 so as to similarly treat the rail welds on the other side of the track.

Alternately, both ends of the apparatus 10 may be equipped with a base grinder assembly 38, as indicated in FIG. 10.

Further, the cart 30 may be fully motorized, if so desired, and in any conventional manner, for self driving along the track, and for automatic movement of the grinder assembly 38 between the positions indicated. Also, a suitable guard arrangement about grinding wheel 38 for protection of the operator may be provided.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. For use on railroad track of the continuous rail type in which the individual rails of the track are made up of rail lengths butt welded together end to end, in joint forming relation, an in-track rail base grinder apparatus for removing excess weld metal protruding from the individual joints at the base of the rail after removal of sufficient ballast from below the joint to expose the rail base at such joint, said apparatus comprising:

a cart having one set of wheels aligned in a first vertical plane for riding onone of the track rails, said cart having a second set of wheels aligned in a second vertical plane for riding on the other of the track rails, said cart defining a frame oriented to extend crosswise of the track when riding on the track rails, said frame at one end of same being formed to define a rollerway extending across one of said vertical planes including a pair of spaced rail members disposed on either side of the rollerway and extending generally longitudinally of said frame, a wheeled carriage mounted on the frame for riding on said rollerway in the operative relation of said carriage, said carriage carrying a post structure that depends therefrom in said operative relation of said carriage on said rollerway, said post structure carrying a grinder head that is positioned to be disposed adjacent the level of the exposed joint rail base, in the operative relation of said carriage, when said cart is seated on the track above the exposed rail joint, said grinder head comprising an elongate body oriented to extend generally longitudinally of said rollerway, said grinder head body defining a head end that in said operative position of said carriage is oriented to be disposed in said one vertical plane below the exposed rail joint, said grinder head body head end including means for rotatably mounting a grinding wheel on the top of same and to one side of said post structure for rotation about an axis extending normally of said head, means for driving the grinding wheel about said axis, said body defining a tail end that extends oppositely of said head end thereof and to the other side of said post structure, said body being connected to said post structure intermediate said ends of said head, and being supported from said post structure to, in said operative position of said carriage, downwardly angle the grinding wheel in a plane that is at a flat angle relation to the horizontal and that includes downwardly in the direction away from said one plane toward said body tail end, means for elevationally disposing said grinder head relative to said carriage to bring the elevationally uppermost portion of the rim of the grinding wheel into grinding contact with the rail base underside at the track joint to be freed of the excess weld metal, means for shifting said grinder head to either side of said body for adjusting the location of said grinding wheel contact with such rail base longitudinally off the rail, and means for moving said carriage and said grinder head laterally across such rail base while maintaining said grinding wheel contact therewith, said means for shifting said grinder head comprising:

said head body being connected to said post structure adjacent said one side thereof by spherical bearing means for swivably supporting said head therefrom, said head body being connected to said post structure by a pair of oppositely vertically adjustable devices spaced substantially equidistant from said grinder wheel axis, in the direction of said tail end of said head body, whereby opposite adjustment of said devices rotationally shifts said grinding wheel contact about said grinding wheel axis.

2. The apparatus set forth in claim 1 wherein:

said adjustable devices each comprise a screw member threadedly connected to said post structure and keyed to said head, each of said screw members having an adjustment handle for rotating the respective screw members relative to said post structure.

3. The apparatus set forth in claim 2 wherein:

said devices are disposed adjacent said other side of said post structure.

4. For use on railroad track of the continuous rail type in which the individual rails of each pair of such rails forming such track define a railroad right of way and are made up of rail lengths welded together end to end in rail joint forming relation in which the joints involved are between adjacent ties of such track, an in-track rail base grinder apparatus for removing excess weld metal protruding from the individual rail joints of such track, and from the underside of the base of the track rail at such joints, after removal of sufficient ballast from below each such track rail joint to expose the track rail base underside at such joint, said apparatus comprising:

a cart having one set of wheels adjacent one end of same aligned in a first upright plane for riding on one of the right of way track rails, and having a second set of wheels adjacent the other end of same aligned in a second upright plane for riding on the other of the right of way track rails, said cart defining a frame oriented to extend crosswise of the track right of way when riding on the right of way defining track rails, with said one end of said cart being formed to project outside of the right of way on one side of the track, said cart at said one end of same being formed to define a carriage way extending across said one upright plane and along said cart one end projection, a wheeled carriage mounted on the cart for riding in said carriage way, said carriage carrying an elongate post structure that extends substantially normally thereof, said carriage being disposable in said carriage way to be positioned substantially upright between said planes with said post structure overlying said carriage way and extending through said first upright plane in the inoperative grinding relation of said apparatus, said carriage being disposable in said carriage way adjacent said cart one end to orient said post structure in substantially upright relation and outside of the track right of way, in an initial preoperative grinding relation of said apparatus, said post structure carrying a grinder head and being proportioned lengthwise thereof to dispose said grinder head below the level of such exposed joint rail base in said initial preoperative grinding relation of said apparatus, when said cart is seated on the track above such exposed rail joint to be ground, said grinder head comprising an elongate body oriented to extend generally normally of said post structure and longitudinally of said carriage way, said grinder head body defining a head end that in the operative grinding relation of said apparatus is to be oriented to intersect said one upright plane below the base of the exposed rail joint, when said carriage is moved from said initial preoperating grinding relation crosswise of and toward said one upright plane to dispose said grinder head in the operative grinding relation of said apparatus, said grinder head body head end including means for rotatably mounting a grinding wheel on the top of same and to one side of said post structure for rotation about an axis extending normally of said head, means for driving the grinding wheel about said axis, said grinder head body defining a tail end that extends substantially oppositely of said head thereof, and to the other side of said post structure, said grinder head body being connected to said post structure intermediate said ends of said head, and being supported from said post structure to, for movement in said operative grinding relation of said apparatus, dispose said grinding wheel for grinding application to the underside of such exposed joint rail base, means for elevationally disposing said grinder head relative to said frame to bring the elevationally uppermost portion of the rim of the grinding wheel into grinding contact with such joint rail base underside to be freed of the excess weld metal, means for shifting said grinder head to either side of said grinder head body for adjusting the location of said grinding wheel contact with such rail base underside longitudinally of the rail, and means for moving said grinder head laterally across the under such rail base while maintaining said grinding wheel contact therewith, for grinding of the excess weld metal protruding from the underside of the rail joint base at such joint.

5. The apparatus set forth in claim 4 wherein:

said carriage way lies in a plane that is canted upwardly for substantial parallelisum to the canting of the bases of said track rails relative to the horizontal.

6. The apparatus set forth in claim 4 wherein:

said grinder head moving means comprises a handle structure connected to said carriage for manually moving said carriage and grinder head laterally across such exposed joint rail base and crosswise of said one upright plane.

7. The apparatus set forth in claim 6 including:

means for shifting as a unit, said carriage, said post structure, and said grinder head, from said operative grinding relation of said apparatus to said apparatus inoperative relation, on said carriage way, using said handle structure.

8. The apparatus set forth in claim 4 including:

means for hand lifting of said cart onto and from its riding relation on the track rails.

9. The apparatus set forth in claim 4 wherein:

said means for shifting said grinder head to either side of said grinder head body comprises:

said head body being connected to said post structure adjacent said one side of said post structure by spherical bearing means for swivably supporting said head therefrom, said head body being connected to said post structure on either side of said body by a pair of oppositely vertically adjustable devices spaced substantially equidistant from said grinder wheel axis, in the directionof said tail end of said head body, and disposed in substantial parallelism to said post structure, whereby opposite adjustment of said devices rotationally shifts said grinding wheel contact about said grinding wheel axis.

10. The apparatus set forth in claim 9 wherein:

said adjustable devices each comprise a screw member threadedly connected to said post structure and keyed to said head, each of said screw members having an adjustment handle for rotating the respective screw members relative to said post structure.

11. The apparatus set forth in claim 10 wherein:
said devices are disposed adjacent said other side of said post structure.

12. The apparatus set forth in claim 4 wherein said post structure comprises:
a first sleeve secured to said carriage for adjustment longitudinally thereof,
a second sleeve in substantially telescoping relation with said first sleeve,
said grinder head being secured to said second sleeve,
and means for telescopingly adjusting said second sleeve relative to said first sleeve and comprising said elevationally disposing means.

13. For use on railroad track of the continuous rail type in which the individual rails of each pair of such rails forming such track define a railroad right of way and being made up of rail lengths welded together end to end in rail joint forming relation in which the joints involved are between adjacent ties of such track, and in-track rail base grinder for removing excess weld metal protruding from the individual rail joints of such track from the underside of the base of the track rail at such joints, after removal of sufficient ballast from below each such track rail joint to expose the track rail base underside at such joint,
said grinder comprising:
a post structure adapted to be disposed adjacent such exposed joint outside said track right of way in substantial upright relation,
said post structure carrying a grinder head that is positioned to be disposed adjacent the level of such exposed joint rail base, in said upright relation of said post structure,
said grinder head comprising an elongate body oriented to extend generally normally of said post structure,
said grinder head body defining a head end that in said upright relation of said post structure is oriented to be disposed below such exposed rail joint base undersurface,
said grinder head body head end including means for rotatably mounting a grinding wheel on the top of same and to one side of said post structure for rotation about an axis extending normally of said head,
means for driving the grinding wheel about said axis,
said grinder head body defining a tail end that extends substantially oppositely of said head end thereof and to the other side of said post structure,
said grinder head body in said upright relation of said post structure being oriented to dispose the grinding wheel below such rail base joint undersurface,
said grinder head body being connected to said post structure intermediate said ends of said head, and being supported from said post structure to, in said upright position of said post structure, dispose said grinding wheel for grinding application to the underside of such exposed joint rail base,
means for elevationally disposing said grinder head to bring the elevationally uppermost portion of the rim of the grinding wheel into grinding contact with such exposed rail base underside at the track joint to be freed of the excess weld metal,
means for shifting said grinder head to either side of said body for adjusting the location of said grinding wheel contact with such exposed rail base underside longitudinally of the rail,
and means for moving said grinder head laterally across such rail base underside while maintaining said grinding wheel contact therewith, when said grinding wheel is driven by said driving means for grinding away the excess weld metal protruding from such exposed joint rail base underside,
said means for shifting said grinder head comprising:
said head body being connected to said post structure adjacent said one side thereof by spherical bearing means for swivably supporting said head therefrom,
said head body being connected to said post structure by a pair of oppositely vertically adjustable devices spaced substantially equidistant from said grinder wheel axis, in the direction of said tail end of said head body,
whereby opposite adjustment of said device rotationally shifts said grinding wheel contact about said grinding wheel axis.

14. The grinder set forth in claim 13 wherein:
said adjustable devices each comprise a screw member threadedly connected to said post structure and keyed to said head,
each of said screw members having an adjustment handle for rotating the respective screw members relative to said post structure.

15. The apparatus set forth in claim 14 wherein:
said devices are disposed adjacent said other side of said post structure.

16. The apparatus set forth in claim 15 wherein said post structure comprises:
a first sleeve including means for supporting same in said upright relation and for shifting same between said upright relation and a retracted position wherein the grinding wheel is disposed the track rails,
a second sleeve in substantially telescoping relation with said first sleeve,
and means for telescopingly adjusting said second sleeve relative to said first sleeve and comprising said elevationally disposing means.

* * * * *